US009541323B2

(12) United States Patent
Kagawa et al.

(10) Patent No.: US 9,541,323 B2
(45) Date of Patent: Jan. 10, 2017

(54) CONDENSATION REMOVAL IN AN OUTDOOR UNIT OF AN AIR CONDITIONING DEVICE

(71) Applicant: DAIKIN INDUSTRIES, LTD., Osaka-shi, Osaka (JP)

(72) Inventors: Mikio Kagawa, Sakai (JP); Fumiaki Koike, Sakai (JP)

(73) Assignee: DAIKIN INDUSTRIES, LTD., Osaka-shi (JP)

( * ) Notice: Subject to any disclaimer, the term of this patent is extended or adjusted under 35 U.S.C. 154(b) by 82 days.

(21) Appl. No.: 14/361,659

(22) PCT Filed: Nov. 7, 2012

(86) PCT No.: PCT/JP2012/078831

§ 371 (c)(1),
(2) Date: May 29, 2014

(87) PCT Pub. No.: WO2013/080760

PCT Pub. Date: Jun. 6, 2013

(65) Prior Publication Data

US 2015/0000321 A1 Jan. 1, 2015

(30) Foreign Application Priority Data

Nov. 30, 2011 (JP) ..... 2011-262616

(51) Int. Cl.
*F25D 21/00* (2006.01)
*F25D 21/14* (2006.01)
(Continued)

(52) U.S. Cl.
CPC ..... *F25D 21/00* (2013.01); *F24F 1/36* (2013.01); *F24F 1/50* (2013.01); *F24F 13/222* (2013.01); *F25D 21/14* (2013.01)

(58) Field of Classification Search
CPC ..... F24F 1/36; F24F 13/222; F25D 21/14
(Continued)

(56) References Cited

U.S. PATENT DOCUMENTS 5,664,430 A * 9/1997 Karman ..... 62/285
8,931,300 B2 * 1/2015 Smith ..... F25D 23/065 62/443

(Continued)

FOREIGN PATENT DOCUMENTS

JP 2000130800 A * 5/2000 ..... F24F 5/00
JP 2007-147250 A 6/2007

OTHER PUBLICATIONS

English translation of Abstract of JP 2000-130800A.*
International Search Report for PCT/JP2012/078831 mailed on Feb. 5, 2013.

*Primary Examiner* — Ryan J Walters
*Assistant Examiner* — Christopher R Zerphey
(74) *Attorney, Agent, or Firm* — Birch, Stewart, Kolasch & Birch, LLP

(57) ABSTRACT

An outdoor unit capable of promptly discharging dew condensation water dropped from a heat exchanger to an exterior is provided. A drainage port is formed in a bottom frame of an outdoor unit below a heat exchanger. A base leg of the bottom frame is formed to have a U shape section by upper plates abutted with a lower surface of the bottom frame, lower plates fixed to an installment surface, and standing plates connecting the upper plates and the lower plates, and further includes a first part and a second part with respect to the longitudinal direction. The first part is formed to have a U shape section opening outward in the horizontal direction with the lower plate thereof being fixed to the installment surface. The second part is provided at least at a position corresponding to the drainage port with respect to the longitudinal direction of the base leg, and formed to have
(Continued)

a U shape section opening inward in the horizontal direction, the second part having a structure where the upper plate thereof avoids a lower region of the drainage port.

8 Claims, 12 Drawing Sheets

(51) Int. Cl.
*F24F 1/50* (2011.01)
*F24F 13/22* (2006.01)
*F24F 1/36* (2011.01)

(58) Field of Classification Search
USPC ..... 62/238.6, 285, 291
See application file for complete search history.

(56) References Cited

U.S. PATENT DOCUMENTS

| | | | | |
|---|---|---|---|---|
| 2005/0000239 | A1* | 1/2005 | Ishihara et al. | 62/298 |
| 2005/0034471 | A1* | 2/2005 | Shin | 62/285 |
| 2007/0169925 | A1* | 7/2007 | Leman et al. | 165/163 |
| 2009/0107161 | A1* | 4/2009 | Jang et al. | 62/259.1 |
| 2011/0154845 | A1* | 6/2011 | Ashida | 62/282 |

* cited by examiner

CONDENSATION REMOVAL IN AN OUTDOOR UNIT OF AN AIR CONDITIONING DEVICE

TECHNICAL FIELD

The present invention relates to an outdoor unit of an air conditioning device.

BACKGROUND ART

Patent Literature 1 below discloses an outdoor unit of an air conditioning device. Devices forming a refrigerant circuit such as a heat exchanger and a compressor are disposed on a bottom frame of this outdoor unit, and base legs to be fixed to an installment surface are provided on lower surfaces of a front edge and a rear edge of the bottom frame below the heat exchanger. Each of the base legs is formed to have a U shape section by a lower plate in contact with the ground, an upper plate in contact with the lower surface of the bottom frame, and a standing plate extending perpendicularly from the upper plate to the lower plate. The base leg provided in the front edge of the bottom frame is formed in a U shape opening forward, and the base leg provided in the rear edge of the bottom frame is formed in a U shape opening rearward.

CITATION LIST

Patent Literature

Patent Literature 1: Japanese Unexamined Patent Publication No. 2007-147250

SUMMARY OF INVENTION

Technical Problem

The bottom frame of the above outdoor unit also has a function as a drain pan for receiving dew condensation water generated in the heat exchanger at the time of a heating operation. Brain holes for discharging the dew condensation water are formed at appropriate points of the bottom frame.

Meanwhile, in a case of the outdoor unit being used in a cold region or the like, since the dew condensation water is sometimes frozen while being attached to the heat exchanger, a defrosting operation of melting and dropping the frozen dew condensation water from the heat exchanger is performed. However, in the conventional outdoor unit, the dew condensation water dropped from the heat exchanger flows on the bottom frame before being discharged from the drain holes. Thus, there is a possibility that the dew condensation water is not promptly discharged to an exterior but frozen again on the bottom frame.

The present invention is achieved in consideration with the situation described above, and an object thereof is to provide an outdoor unit of an air conditioning device capable of promptly discharging dew condensation water dropped from a heat exchanger to an exterior.

Solution to Problem (1) The present invention is an outdoor unit of an air conditioning device including a bottom frame, a heat exchanger disposed on the bottom frame, and a base leg provided on a lower surface of the bottom frame below the heat exchanger, wherein a drainage port is formed in the bottom frame below the heat exchanger, the base leg is formed to have a U shape section by upper plates abutted with the lower surface of the bottom frame, lower plates mounted on an installment surface, and standing plates connecting the upper plates and the lower plates, the base leg further includes a first part serving as a part in the longitudinal direction, and a second part serving as another part in the longitudinal direction, the first part is formed to have a U shape section opening outward in the horizontal direction with the lower plate thereof being fixed to the installment surface, and the second part is provided at least at a position corresponding to the drainage port with respect to the longitudinal direction of the base leg, and formed to have a U shape section opening inward in the horizontal direction, the second part having a structure where the upper plate thereof avoids a lower region of the drainage port.

With the above configuration, the drainage port is formed in the bottom frame below the heat exchanger. Thus, dew condensation water dropped from the heat exchanger can be promptly discharged from the drainage port. Therefore, the dew condensation water melted by a defrosting operation or the like is hardly frozen again on the bottom frame. Since the second part has the structure where the upper plate of the second part of the base leg avoids the lower region of the drainage port, water can be properly discharged to an exterior of the outdoor unit from the drainage port without being obstructed by the upper plate. Since the second part is formed in a U shape opening inward in the horizontal direction, water flowing down from the drainage port, a trace of water coming down the base leg, and the like are not exposed to the exterior, so that an appearance is hardly deteriorated. Further, since the first part of the base leg is formed in a U shape opening outward in the horizontal direction, workability is not deteriorated at the time of fixing the base leg to the installment surface.

(2) Preferably, the upper plate of the second part has a retreat portion retreating to the outer side in the horizontal direction of the drainage port at least in the vicinity of the drainage port.

With such a configuration, while the upper plate of the second part has a simple structure, water can be properly discharged to the exterior of the outdoor unit from the drainage port.

(3) Preferably, a support portion protruding to the inner side in the horizontal direction of the retreat portion and supporting the lower surface of the bottom frame is provided in the second part.

When the upper plate of the second part has the retreat portion retreating to the outer side in the horizontal direction, an area of the bottom frame to be abutted with the upper plate is reduced, and there is a possibility that support strength is lowered. However, by providing the support portion protruding to the inner side in the horizontal direction of the retreat portion, the support strength of the bottom frame can be sufficiently ensured.

(4) Preferably, the support portion is arranged at a position to avoid the drainage port.

With such a configuration, deterioration of a drainage property from the drainage port due to the support portion can be prevented.

(5) A mount portion for mounting the heat exchanger may be formed in the bottom frame while expanding upward, and the drainage port may be formed in the mount portion.

By forming the drainage port in the mount portion in direct contact with the heat exchanger in such a way, the drainage property of water dropped from the heat exchanger can be more enhanced.

(6) A water outflow prevention structure for preventing an outflow of water from the lower plate of the second part to the lower plate of the first part may be provided in a border portion between the lower plate of the first part and the lower plate of the second part or in the lower plate of the second part.

With such a configuration, even when the dew condensation water discharged from the drainage port is dropped down onto the lower plate of the second part, the dew condensation water can be prevented from flowing out to the lower plate of the first part. Thus, a flow of the dew condensation water and a trace thereof can be prevented from being exposed to the exterior.

Advantageous Effects of Invention

According to the present invention, the dew condensation water dropped from the heat exchanger can be promptly discharged to the exterior.

DESCRIPTION OF EMBODIMENTS

Figure 1:
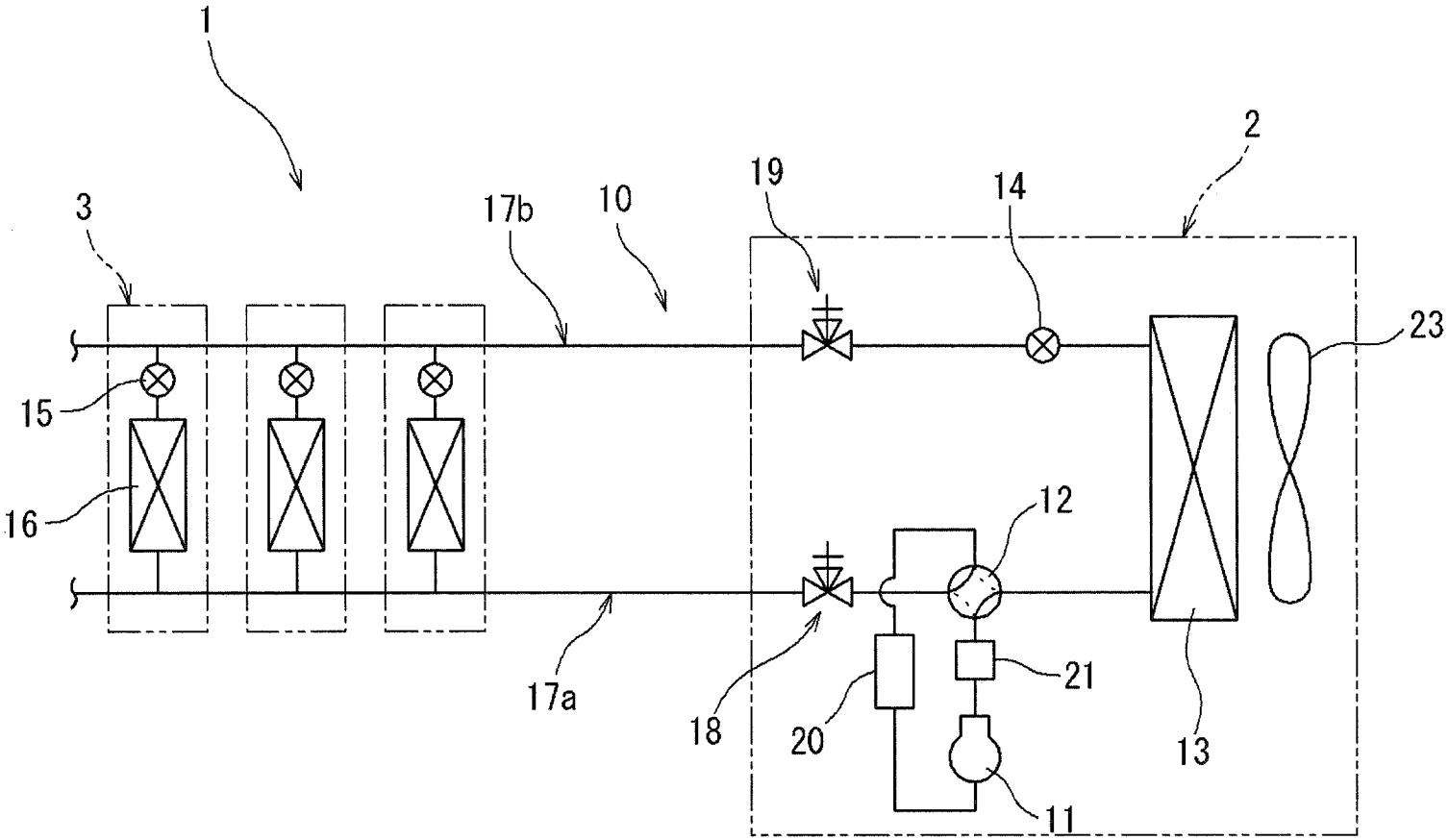
FIG. 1 is a pattern diagram showing a refrigerant circuit of an air conditioning device having an outdoor unit according to a first embodiment of the invention.

FIG. 1 is a pattern diagram showing a refrigerant circuit of an air conditioning device having an outdoor unit according to a first embodiment of the present invention.

An air conditioning device 1 is for example a multiple type air conditioning device for a building in which a refrigerant circuit 10 is formed in such a manner that a plurality of indoor units 3 are connected in parallel to one or a plurality of outdoor units 2 so as to circulate a refrigerant.

In the outdoor unit 2, a compressor 11, a four way valve 12, an outdoor heat exchanger 13, an outdoor expansion valve 14, an accumulator 20, an oil separator 21, and the like are provided. These parts are connected by a refrigerant pipe. A fan 23 is provided in the outdoor unit 2. In the indoor unit 3, an indoor expansion valve 15, an indoor heat exchanger 16, and the like are provided. The four way valve 12 and the indoor heat exchanger 16 are connected by a gas side refrigerant communication pipe 17*a*, and the outdoor expansion valve 14 and the indoor expansion valve 15 are connected by a liquid side refrigerant communication pipe 17*b*. A gas side stop valve 18 and a liquid side stop valve 19 are provided in terminal portions of the inside refrigerant circuit of the outdoor unit 2. The gas side stop valve 18 is arranged on the side of the four way valve 12, and the liquid side stop valve 19 is arranged on the side of the outdoor expansion valve 14. The gas side refrigerant communication pipe 17*a* is connected to the gas side stop valve 18, and the liquid side refrigerant communication pipe 17*b* is connected to the liquid side stop valve 19.

In a case where a cooling operation is performed in the air conditioning device 1 with the above configuration, the four way valve 12 is retained in a state shown by solid lines in FIG. 1. A high temperature and high pressure gas refrigerant discharged from the compressor 11 flows into the outdoor heat exchanger 13 via the oil separator 21 and the four way valve 12, and performs heat exchange with the outdoor air by actuation of the fan 23 so as to be condensed and liquefied. The liquefied refrigerant passes through the outdoor expansion valve 14 in a fully open state, and flows into the indoor units 3 through the liquid side refrigerant communication pipe 17*b*. In the indoor unit 3, pressure of the refrigerant is reduced to predetermined low pressure by the indoor expansion valve 15, and the refrigerant performs the heat exchange with the indoor air in the indoor heat exchanger 16 so as to be evaporated. The indoor air cooled by evaporation of the refrigerant is blown out to an interior by an indoor fan (not shown) so as to cool the interior. The refrigerant evaporated and gasified in the indoor heat exchanger 16 is returned to the outdoor unit 2 through the gas side refrigerant communication pipe 17*a*, and suctioned into the compressor 11 via the four way valve 12 and the accumulator 20.

On the other hand, in a case where a heating operation is performed, the four way valve 12 is retained in a state shown by broken lines in FIG. 1. A high temperature and high pressure gas refrigerant discharged from the compressor 11 flows into the indoor heat exchanger 16 of the indoor unit 3 via the oil separator 21 and the four way valve 12, and performs the heat exchange with the indoor air so as to be condensed and liquefied. The indoor air heated by condensation of the refrigerant is blown out to the interior by the indoor fan so as to heat the interior. The refrigerant liquefied in the indoor heat exchanger 16 is returned to the outdoor unit 2 from the indoor expansion valve 15 in a fully open state through the liquid side refrigerant communication pipe 17*b*. The pressure of the refrigerant returned to the outdoor unit 2 is reduced to predetermined low pressure by the outdoor expansion valve 14, and further, the refrigerant performs the heat exchange with the outdoor air in the outdoor heat exchanger 13 so as to be evaporated. The refrigerant evaporated and gasified in the outdoor heat exchanger 13 is suctioned into the compressor 11 via the four way valve 12 and the accumulator 20.

Figure 2:
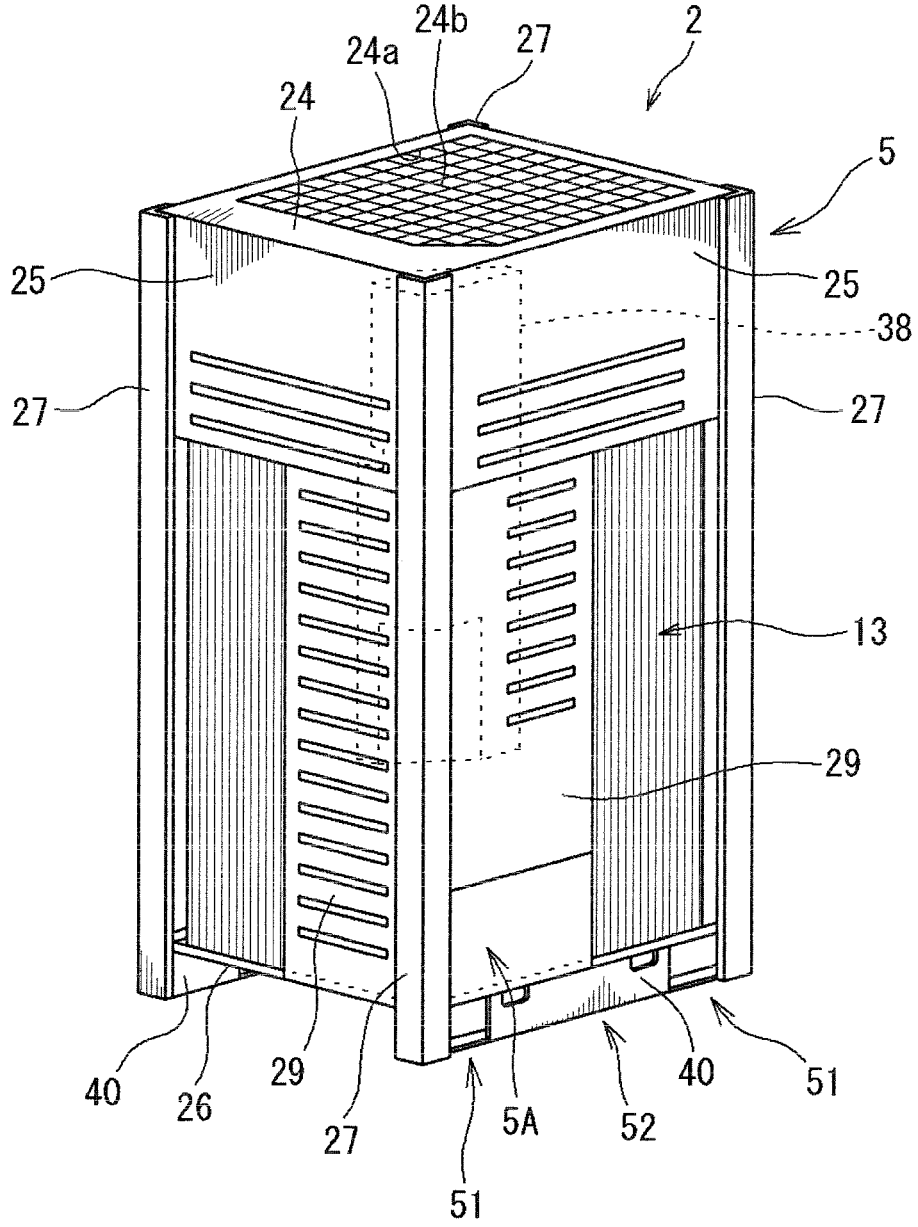
FIG. 2 is a perspective view showing an outer appearance of the outdoor unit.
Figure 3:
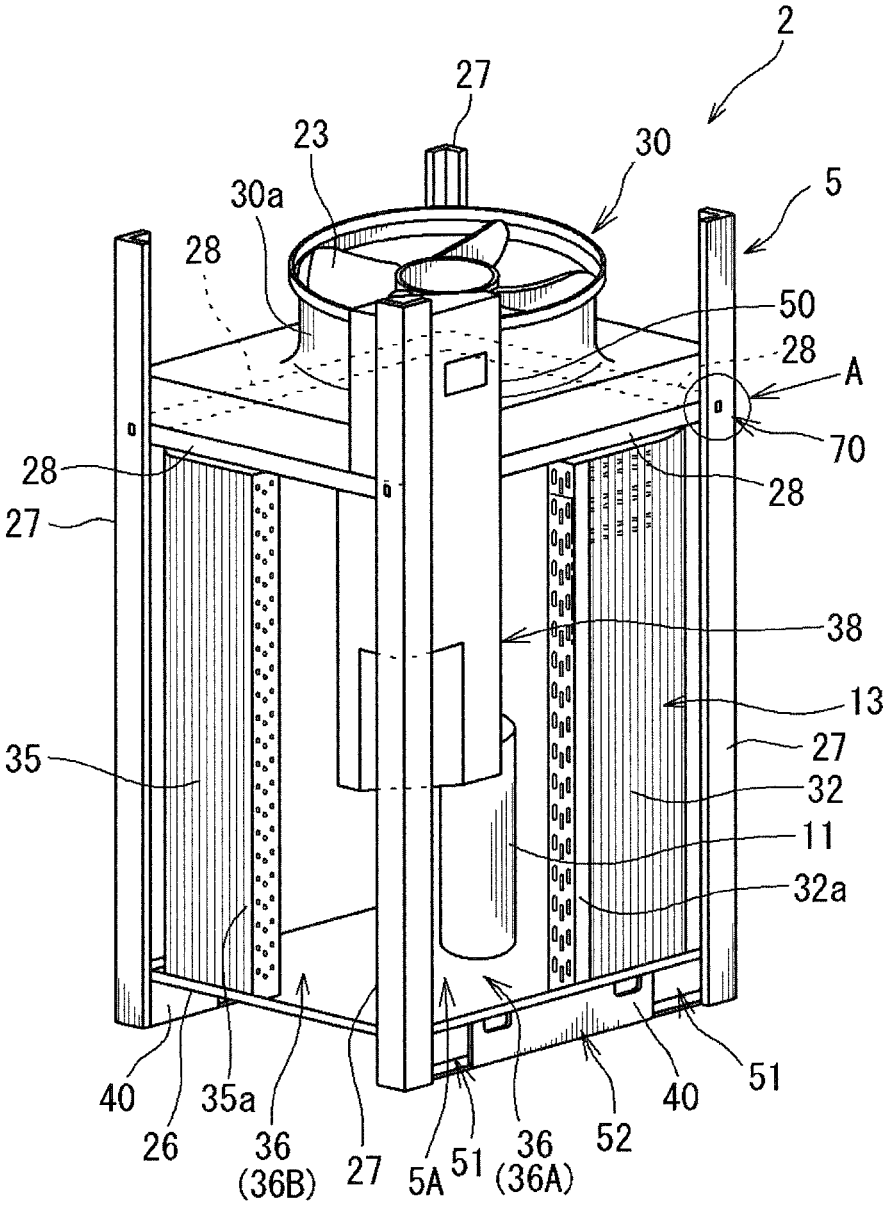
FIG. 3 is a schematic perspective view showing a state where side panels and a top plate of the outdoor unit are removed.

FIG. 2 is a perspective view showing an outer appearance of the outdoor unit, and FIG. 3 is a schematic perspective view showing a state where side panels and a top plate of the outdoor unit are removed.

The outdoor unit 2 of the present embodiment is an upward blow-off type including an outdoor unit main body (casing) 5, the devices forming the refrigerant circuit 10 (refer to FIG. 1) such as the outdoor heat exchanger 13, the compressor 11, the four way valve 12, the accumulator 20, and the oil separator 21, and an electric component unit 38 which are built in this outdoor unit main body 5, the fan 23 provided in an upper part of the outdoor unit main body 5, and the like.

The outdoor unit 2 suctions the air from side surfaces of the outdoor unit main body 5 by driving the fan 23, performs the heat exchange between the air and the outdoor heat exchanger 13, and then blows off the air upward from the upper part of the outdoor unit main body 5.

As shown in FIGS. 2 and 3, the outdoor unit main body 5 is formed in a substantially rectangular parallelepiped shape, and has a bottom frame 26, support pillars 27, beam members 28, lower side surface panels 29, upper side surface panels 25, a top plate 24, and the like. The bottom frame 26 is formed in a square shape in a plan view. Base legs 40 connected to the ground are provided in two sides of the bottom frame 26 facing each other in the front and rear direction. The support pillars 27 are formed by long members elongated in the up and down direction, and attached to four corners of the bottom frame 26 by bolts or the like.

As shown in FIG. 2, the top plate 24 is formed in a square shape in a plan view which is the substantially same as the bottom frame 26, and arranged so as to have a gap on the upper side of the bottom frame 26. Upper ends of the support pillars 27 are coupled to four corners of the top plate 24 by coupling tools such as bolts. A substantially square ventilating hole 24*a* is formed in the top plate 24, and a net body 24*b* for preventing invasion of foreign substances is provided in the ventilating hole 24*a*.

As shown in FIG. 3, the beam members 28 are arranged on the upper part side of the support pillars 27 at positions having a predetermined gap downward from the top plate 24, and bridged between the support pillars 27 adjacent to each other in the front and rear direction and the left and right direction. A framework of the outdoor unit main body 5 is formed by structural members including the bottom frame 26, the top plate 24, the support pillars 27, the beam members 28, and the like.

A bell mouth 30 is attached to the four beam members 28. The bell mouth 30 has a ventilating guide (ventilating member) 30*a* surrounding an outer circumferential part of the fan 23. The ventilating guide 30*a* forms a blow off port of the air from the outdoor unit main body 5. A support base (not shown) is bridged over the front and rear beam members 28, and the fan 23 is attached to the support base. Therefore, the beam members 28 also function as attachment members for attaching the fan 23.

Figure 4:
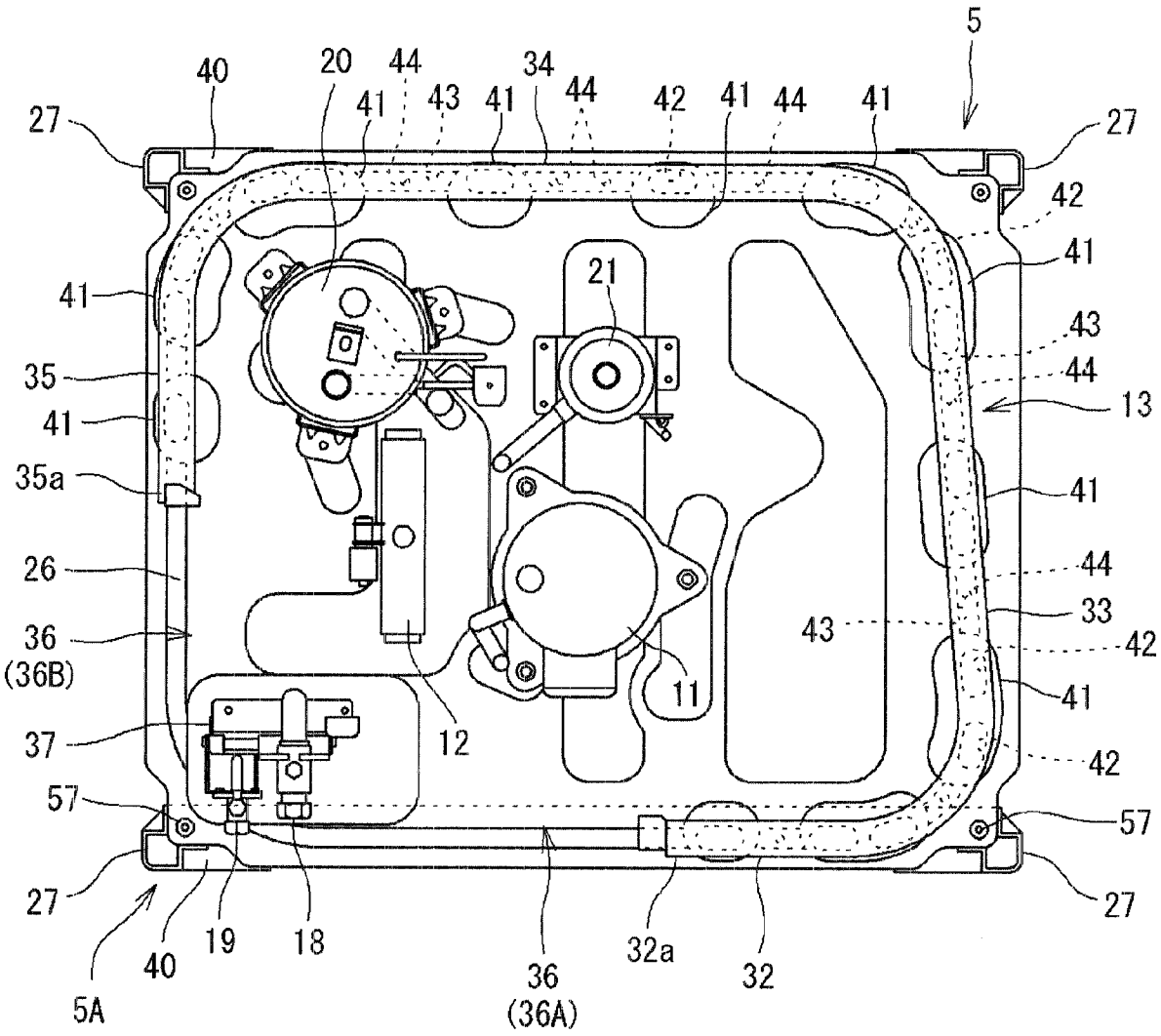
FIG. 4 is a plan view of an interior of the outdoor unit.

FIG. 4 is a plan view of an interior of the outdoor unit.

As shown in FIG. 4, the devices such as the outdoor heat exchanger 13, the compressor 11, the accumulator 20, the oil separator 21, and the four way valve 12 are disposed on an upper surface of the bottom frame 26 of the outdoor unit main body 5. The outdoor heat exchanger 13 is a cross fin coil type in which heat transfer tubes horizontally pass through a large number of aluminum fins, and the heat exchange is performed between the refrigerant flowing through the heat transfer tubes and the air circulated in the outdoor heat exchanger 13.

The outdoor heat exchanger 13 is bent in a substantially square shape so as to face (correspond to) the four side surfaces in a range excluding one corner portion (left front corner portion) 5A of the outdoor unit main body 5 along the four side surfaces. Specifically, the outdoor heat exchanger 13 has a front heat exchange portion 32 along the side surface on the front side of the outdoor unit main body 5 (front surface), a right heat exchange portion 33 along the side surface on the right side, a rear heat exchange portion 34 along the side surface on the rear side (rear surface), and a left heat exchange portion 35 along the side surface on the left side. A Part between the front heat exchange portion 32 and the right heat exchange portion 33, a part between the right heat exchange portion 33 and the rear heat exchange portion 34, and a part between the rear heat exchange portion 34 and the left heat exchange portion 35 are bent at substantially 90 degrees.

In the outdoor unit main body 5, the lower side panels 29 for closing an opening portion 36 (front opening portion 36A) formed between a left end portion 32*a* of the front heat exchange portion 32 and the left front support pillar 27 and an opening portion 36 (left opening portion 36B) formed between this support pillar 27 and a front end portion 35*a* of the left heat exchange portion 35 are detachably provided (refer to FIG. 2).

It should be noted that the heat exchange portions 32 to 35 of the outdoor heat exchanger 13 do not necessarily face the side surfaces of the Outdoor unit main body 5 in parallel but may face the side surfaces in an inclined state.

As shown in FIG. 3, the electric component unit 38 includes electric parts control board for controlling the entire outdoor unit 2, a drive board (inverter board) for driving the compressor 11 and the fan 23, a reactor, and a terminal block, and an electric component box 50 accommodating these electric parts. The electric component unit 38 is arranged corresponding to the one corner portion 5A in the outdoor unit main body 5, that is, the corner portion 5A of the outdoor unit main body 5 where the outdoor heat exchanger 13 is not arranged. The electric component unit 38 is attached to and supported on the support pillar 27 arranged in the corner portion 5A, the beam members 28 coupled to this support pillar 27, and the like by bolts or the like.

As shown in FIG. 4, the stop valves 18 and 19 are supported via an attachment base 37 so as to face the front opening portion 36A of the outdoor unit main body 5. The compressor 11 is arranged closely to a right side part of the front opening portion 36A at such a position that the substantially entire compressor can be visually recognized from the front side via the front opening portion 36A. The accumulator 20 and the oil separator 21 on the bottom frame 26 are arranged on the rear part side in the outdoor unit main body 5.

Mount portions 41 slightly expanding upward are formed at a plurality of points in the bottom frame 26 below the outdoor heat exchanger 13, and the outdoor heat exchanger 13 is disposed on the mount portions 41. The mount portions 41 of the present embodiment are formed in a substantially oval shape or a substantially elliptic shape in a plan view. A drainage port 42 passing through in the up and down direction is formed in each of the mount portions 41. A recessed drainage passage 43 is formed between the adjacent mount portions 41 below the outdoor heat exchanger 13. Drainage ports 44 are also formed in the drainage passage 43.

Therefore, dew condensation water generated in the outdoor heat exchanger 13 when a heating operation is performed is discharged from the drainage ports 42 and 44 formed in the mount portions 41 and the drainage passage 43 to the lower side of the bottom frame 26. Even in a case where the dew condensation water frozen in the outdoor heat exchanger 13 is melted by a defrosting operation or the like, the dew condensation water is discharged from the drainage ports 42 and 44 to the lower side of the bottom frame 26. Since the drainage ports 42 and 44 are placed below the outdoor heat exchanger 13, the dew condensation water can be promptly discharged, and in particular, the dew condensation water melted by the defrosting operation can be favorably prevented from being frozen again on the bottom frame 26 or the like.

Figure 7:
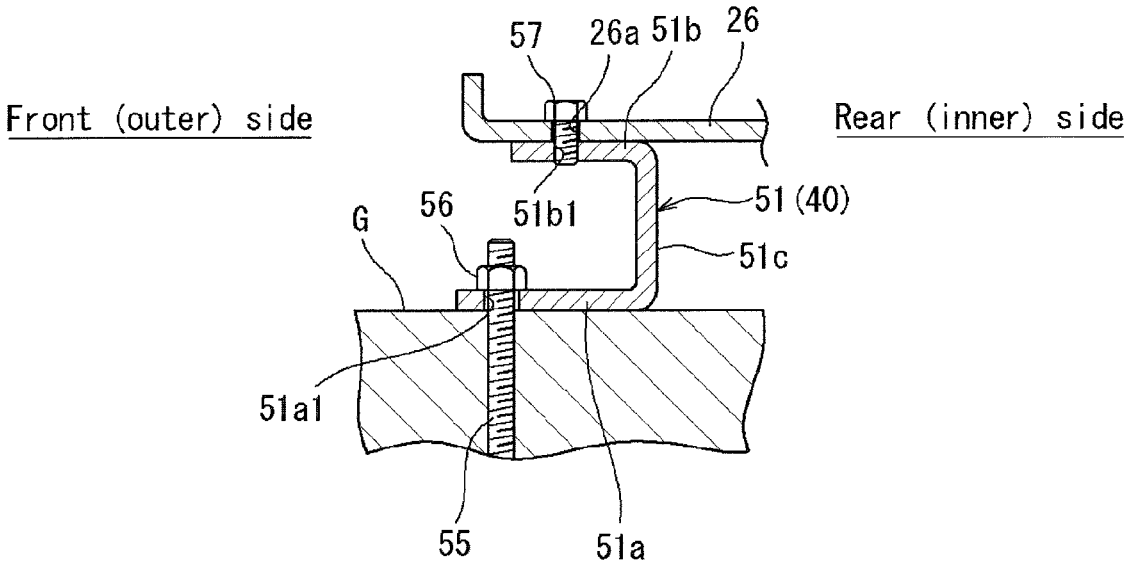
FIG. 7 is a sectional view of a first part of the base leg.
Figure 8:
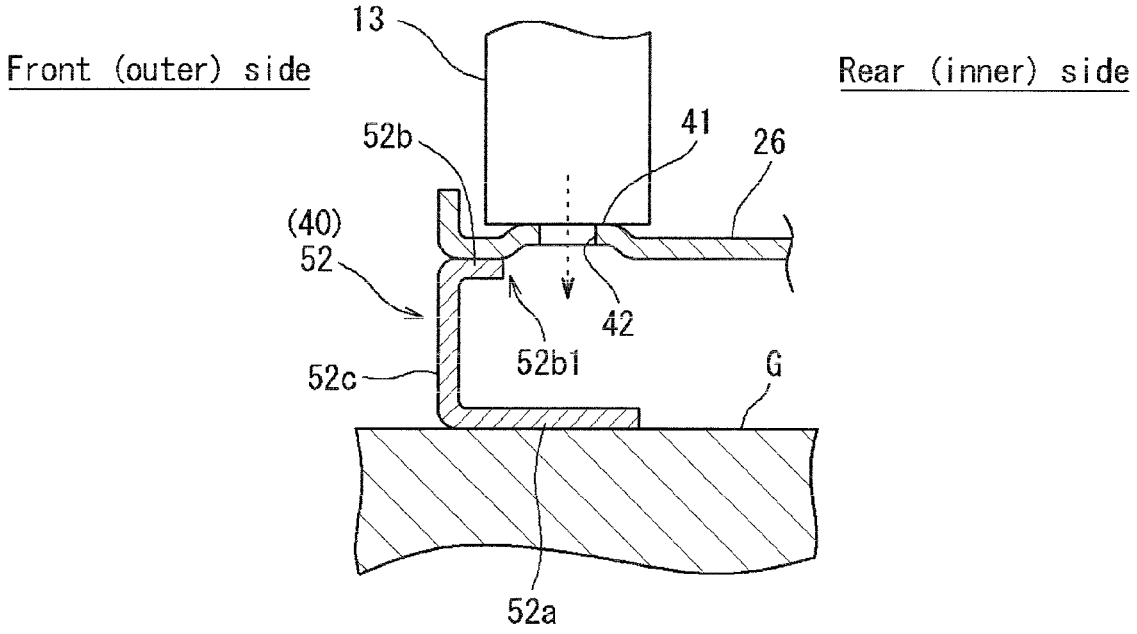
FIG. 8 is a sectional view of a second part of the base leg.

As shown in FIGS. 2 to 4, the base legs 40 are provided in a front edge and a rear edge of the bottom frame 26, and the base legs 40 are fixed to an installment surface (base surface) G for installing the outdoor unit 2 (refer to FIGS. 7 and 8).

Figure 5:
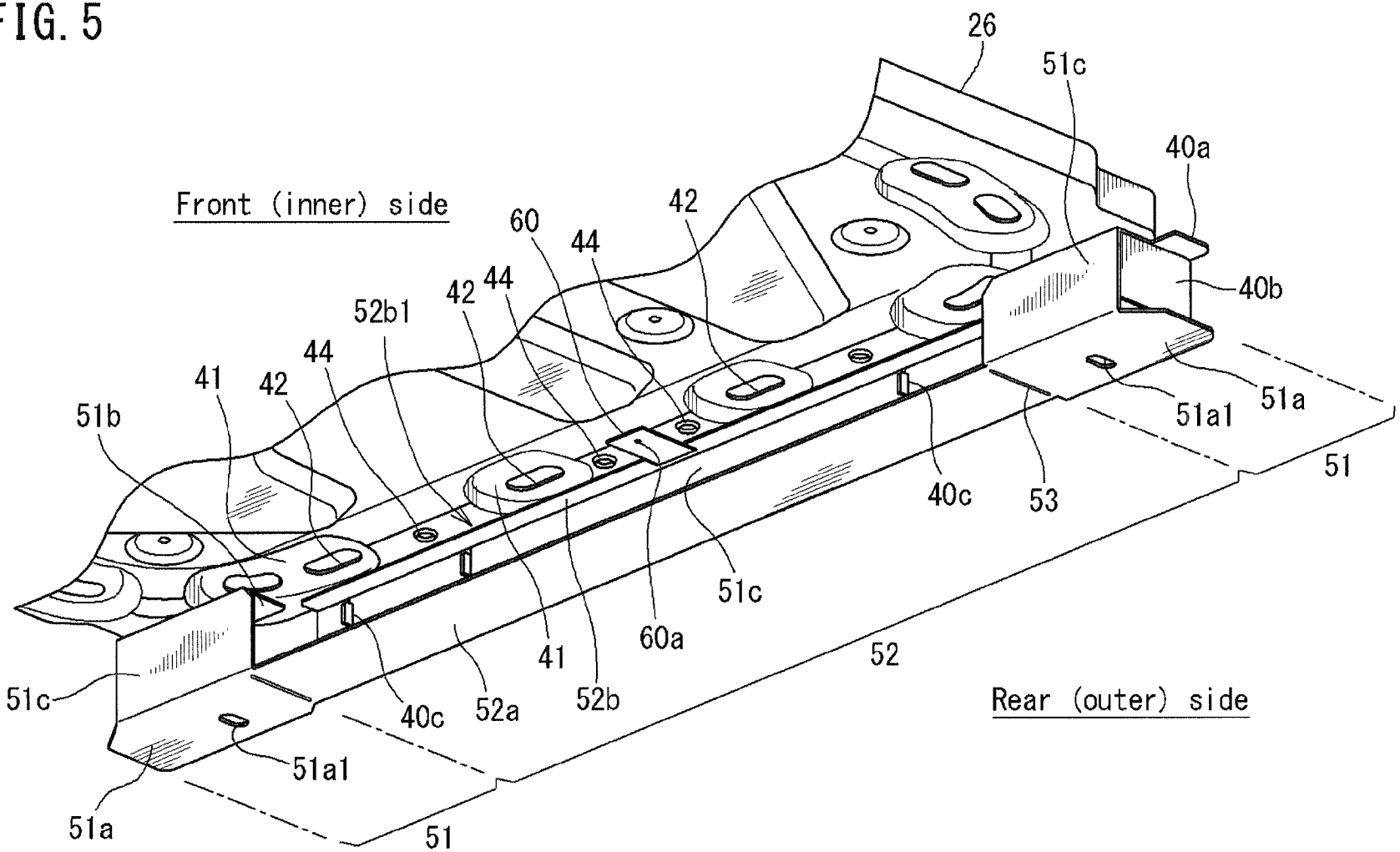
FIG. 5 is a perspective view of a base leg on the rear side and a part of a bottom frame when seen from the obliquely lower side.
Figure 6:
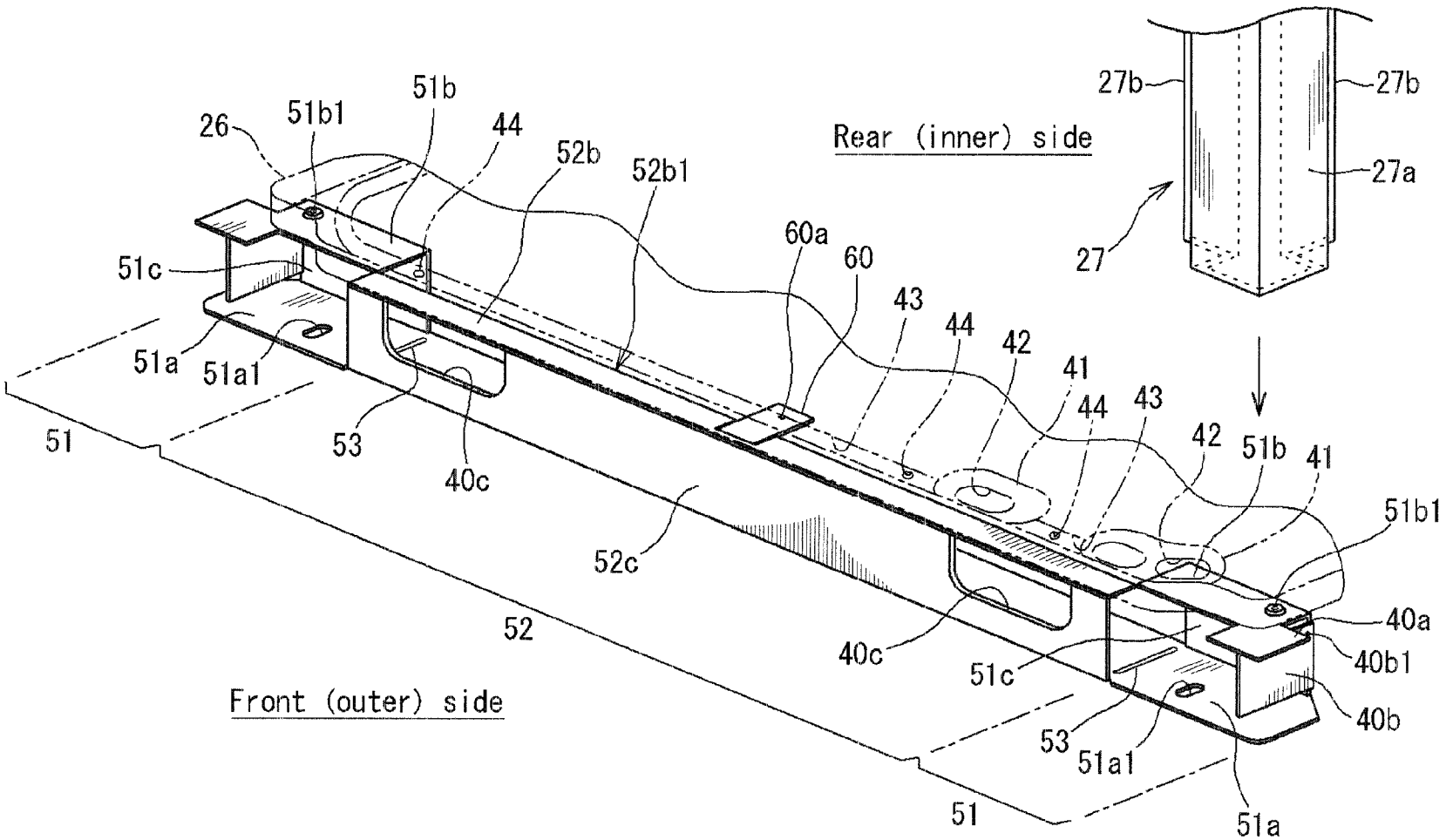
FIG. 6 is a perspective view of a base leg on the front side when seen from the obliquely upper side

FIG. 5 is a perspective view of the base leg on the rear side and a part of the bottom frame when seen from the obliquely lower side, and FIG. 6 is a perspective view of the base leg on the front side when seen from the obliquely upper side. FIG. 7 is a sectional view of a first part of the base leg, and FIG. 8 is a sectional view of a second part of the base leg.

Each of the base legs 40 of the present embodiment includes first parts 51 and a second part 52 with respect to the longitudinal direction. The first parts 51 correspond to both end portions in the longitudinal direction of the base leg 40, and the second part 52 corresponds to a part between the first parts 51 serving as both the end portions in the longitudinal direction.

Each of the first parts 51 is formed by a lower plate 51*a* mounted on the installment surface G, an upper plate 51*b* abutted with a lower surface of the bottom frame 26, and a standing plate 51*c* connecting the upper plate 51*b* and the lower plate 51*a*, and formed to have a U shape section. The second part 52 is formed by a lower plate 52*a* mounted on the installment surface G, an upper plate 52*b* abutted with a lower surface of the bottom frame 26, and a standing plate 52*c* connecting the upper plate 52*b* and the lower plate 52*a*, and formed to have a U shape section. However, the first parts 51 are formed to have a U shape section opening outward in the front and rear direction, and the second part 52 is formed to have a U shape section opening inward in the front and rear direction. That is, as shown in FIG. 5, in the base leg 40 on the rear side, the first parts 51 open rearward, and the second part 52 opens forward. As shown in FIG. 6, in the base leg 40 on the front side, the first parts 51 open forward, and the second part 52 opens rearward. The lower plates 51*a* and 52*a* of the first parts 51 and the second part 52 are formed continuously over the entire length of the base leg 40. The base leg 40 is formed by bending a plate material.

As shown in FIG. 7, a bolt insertion hole 51*a*1 is formed in the lower plate 51*a* of each of the first parts 51. By mounting the lower plate 51*a* on the installment surface G, inserting an anchor bolt 55 planted on the installment surface G into the bolt insertion hole 51*a*1, and screwing a nut 56 onto the anchor bolt 55, the base leg 40 is fixed to the installment surface. A female screw hole 51*b*1 is formed in the upper plate 51*b* of the first part 51. By mounting the bottom frame 26 on the upper plate 51*b*, inserting a bolt 57 into a bolt insertion hole 26*a* formed in the corner part of the bottom frame 26, and screwing the bolt 57 into the female screw hole 51*b*1, the bottom frame 26 is fixed to the base leg 40.

As described above, since the first part 51 is formed to have a U shape section opening outward in the front and rear direction, a task of inserting the anchor bolt 55 into the bolt insertion hole 51*a*1 can be performed while visually recognizing from an exterior, and a task of screwing side of the outdoor unit 2.

As shown in FIG. 8, the lower plate 52*a* of the second part 52 is mounted on the installment surface G but not directly fixed by the anchor bolt 55 unlike the lower plate 51*a* of the first part 51. The lower surface of the bottom frame 26 is abutted with and directly supported on the upper plate 52*b* of the second part 52.

The upper plate 52*b* in the second part 52 has smaller width in the front and rear direction than the upper plate 51*b* of the first part 51 (refer to FIG. 7), and is formed so as to retreat to the outer side in the front and rear direction from a lower region of the drainage ports 42 and the drainage ports 44 formed in the bottom frame 26 (refer to FIG. 6). Therefore, when the Dew condensation water flowing down from the outdoor heat exchanger 13 is discharged from the drainage ports 42 and 44, the upper plate 52*b* is not disturbing, so that the dew condensation water can be properly discharged to the side of the installment surface G.

Since the second part 52 is formed in a U shape opening inward in the front and rear direction, the dew condensation water drained from the drainage ports 42, a trace of the dew condensation water, or the like is hidden by the standing plate 52*c* so as not to be exposed to the exterior. Therefore, an appearance of the outdoor unit 2 is hardly deteriorated.

It should be noted that the upper plate 52*b* of the present embodiment has small width in the front and rear direction over the entire length thereof. In other words, a retreat portion 52*b*1 retreating from the lower region of the drainage ports 42 is formed in the entire upper plate 52*b*. However, such a retreat portion 52*b*1 can also be formed only in a part corresponding to the lower region of the drainage ports 42.

The second part 52 may be formed only in a part corresponding to the drainage ports 42 and 44. That is, in the present embodiment, the first parts 51 are formed in both the end portions in the longitudinal direction of the base leg 40, and the part between the first parts entirely serves as the second part 52. However, only the part corresponding to the drainage ports 42 and 44 in the part between the first parts 51 in both the end portions of the base leg 40 may serve as the second part 52 opening inward in the front and rear direction, and the other parts not corresponding to the drainage ports 42 and 44 may open outward in the front and rear direction as well as the first parts 51.

As described above, the retreat portion 52*b*1 is formed in the upper plate 52*b* of the second part 52. Thus, a contact area with the bottom frame 26 is decreased, so that there is a negative effect that support strength of the bottom frame 26 is accordingly lowered. Therefore, a support portion 60 supporting the bottom frame 26 with the upper plate 52*b* is provided in the base leg 40 of the present embodiment. As shown in FIG. 6, the support portion 60 is formed by a substantially rectangular plate material formed as a separate body from the base leg 40, and attached so as to protrude inward in the front and rear direction from the standing plate 52*c* of the second part 52. A female screw hole 60*a* into which a bolt for fixing the bottom frame 26 is screwed is formed in the support portion 60. The support portion 60 is provided at a position to avoid the drainage ports 42 and 44 formed in the bottom frame 26, specifically between the adjacent drainage ports 42 and 44. By providing such a support portion 60, even when the retreat portion 52*b*1 is formed in the upper plate 52*b* of the second part 52, the support strength of the bottom frame 26 can be sufficiently ensured. It should be noted that in the example shown in FIG. 6, only one support portion 60 is provided. However, support portions 60 may be provided at a plurality of points to avoid the drainage ports 42 and 44.

As shown in FIG. 6, opening portions 40*c* to be used for inserting transportation ropes or forks of a forklift truck are formed at two points placed away from each other in the longitudinal direction in the standing plate 52*c* of the second part 52 of the base leg 40.

Ribs 53 extending in the front and rear direction protrude from borders between the lower plates 51*a* of the first parts 51 and the lower plate 52*a* of the second part 52 of the base leg 40. The ribs 53 have a function of preventing the dew condensation water dropped from the drainage ports 42 and 44 from flowing out from the lower plate 52*a* of the second part 52 to the side of the lower plates 51*a* of the first parts 51 (water outflow prevention function). Therefore, the dew condensation water can be prevented from flowing out from the first parts 51 opening outward in the front and rear direction so as to be exposed to the exterior.

It should be noted that the ribs 53 having the water outflow prevention function are not limited to the borders between the lower plates 51*a* and the lower plate 52*a* but may be formed at appropriate points in the middle of the longitudinal direction of the lower plate 52*a*. When the ribs are formed at any points of the lower plate 52*a*, an effect of reducing the dew condensation water flowing out from the lower plates 51*a* of the first parts 51 can be exerted. The ribs 53 may be formed by letting a part of the lower plate 52*a* protrude upward or may be formed by fixing a separate member to the lower plate 52*a*.

The upper plates 51*b* of the first parts 51 and the upper plate 52*b* of the second part 52 are formed so as not to be overlapped with each other in the left and right direction. Therefore, at the time of forming the first parts 51 and the second part 52 by bending one plate material, the processing can be easily performed.

Figure 9:
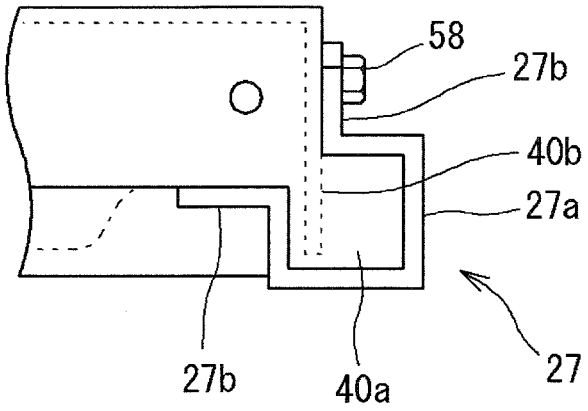
FIG. 9 is a plan view showing a coupling part between an end portion of the base leg and a support pillar.

FIG. 9 is a plan view showing a coupling part between an end portion of the base leg and the support pillar.

As shown in FIGS. 6 and 9, a fitting portion 40*a* to be fitted to a lower end portion of the support pillar 27 is provided in the end portion of the base leg 40. The fitting portion 40*a* is integrated with an end portion of the upper plate 51*b* of the first part 51 of the base leg 40, and formed in a substantially regular square shape in a plan view. A support plate 40*b* bent in the front and rear direction is provided in an end portion of the standing plate 51*c* of the first part 51. A female screw hole 40*b*1 is formed in the support plate 40*b*.

Meanwhile, the support pillar 27 has a main body portion 27*a* bent in a substantially square tubular shape in which one corner portion is opened, in a plan view, and a pair of attachment plates 27*b* extending in the front and rear direction and the left and right direction from both ends of the opened part of the main body portion 27*a*. By fitting the main body portion 27*a* of the support pillar 27 to the fitting portion 40*a* and screwing a bolt 58 inserted into a bolt insertion hole (not shown) which is formed in one of the attachment plates 27*b* into the female screw hole 40*b*1 formed in the support plate 40*b*, the support pillar 27 is fixed to the base leg 40. The attachment plates 27*b* of the support pillar 27 are also fixed to an edge portion of the bottom frame 26 by bolts (not shown).

Figure 10A:
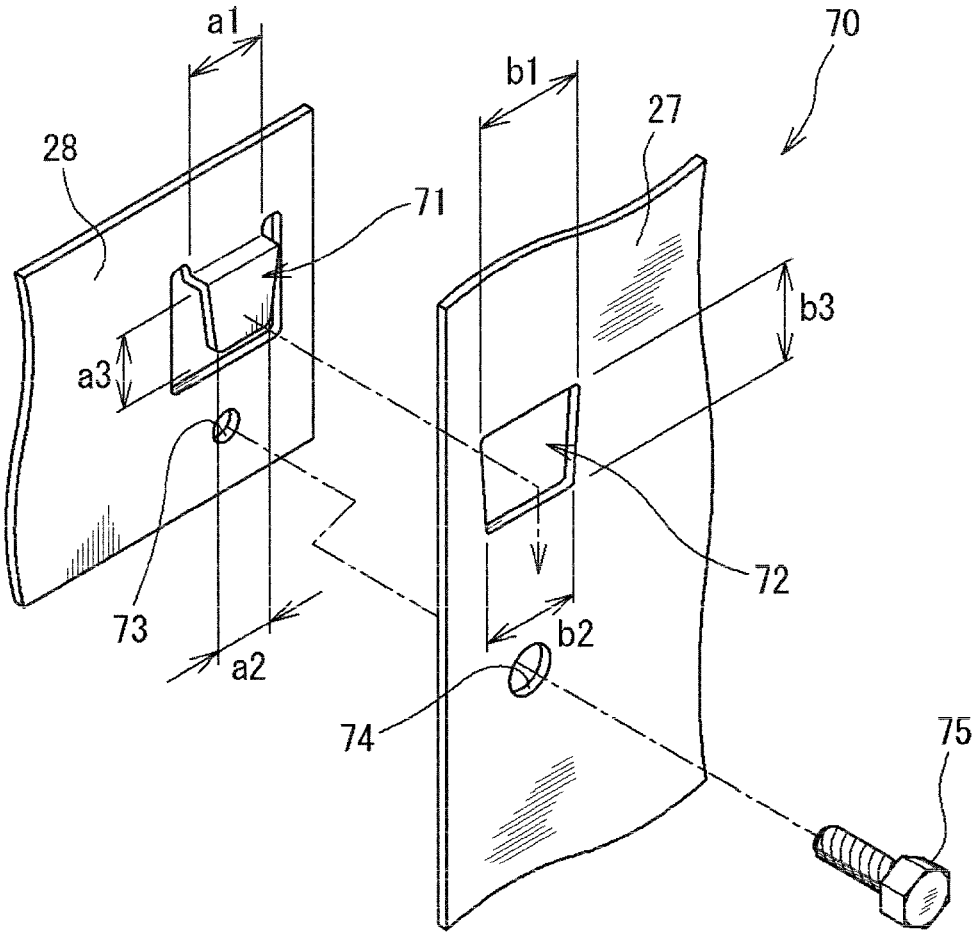
FIG. 10A is an exploded perspective view showing a coupling structure between the support pillar and a beam member.
Figure 10B:
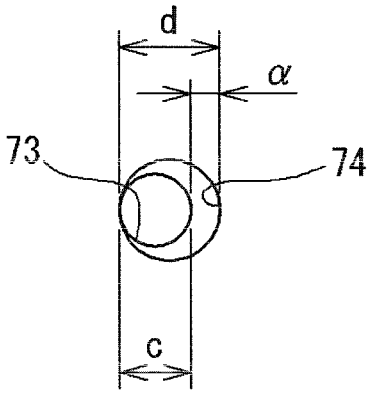
FIG. 10B is an illustrative view showing a size difference between a bolt insertion hole and a bolt.
Figure 11:
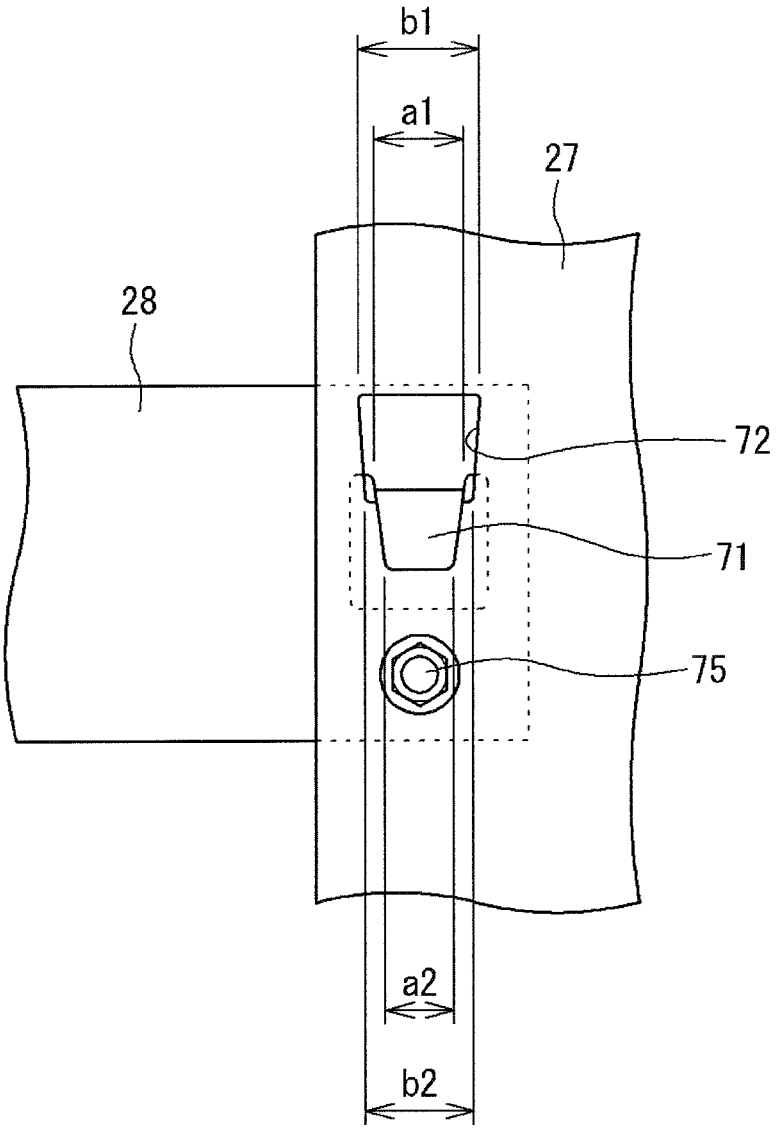
FIG. 11 is a front view showing the coupling structure between the support pillar and the beam member.

As shown in an A part of FIG. 3, the support pillar 27 and the beam member 28 are coupled by a predetermined coupling structure 70. FIG. 10 is an exploded perspective view showing the coupling structure between the support pillar and the beam member, and FIG. 11 is a front view showing the coupling structure between the support pillar and the beam member.

The coupling structure 70 of the present embodiment has an engagement hook 71 formed in an end portion of the beam member 28, and an engagement hole 72 formed in the support pillar 27. The engagement hook 71 is formed by bending and letting a part of the beam member 28 extend forward in an L shape. The engagement hook 71 is formed in a substantially trapezoid shape in which width a2 of a tip end portion (lower end portion) is smaller than width a1 of a base end portion (upper end portion). A female screw hole 73 is formed below the engagement hook 71.

Meanwhile, the engagement hole 72 formed in the support pillar 27 is formed to have larger size than the engagement hook 71. Specifically, the engagement hole 72 is formed in a substantially trapezoid shape in which width b2 of a lower end edge is smaller than width b1 of an upper end edge. Height b3 in the up and down direction of the engagement hole 72 is larger than height a3 in the up and down direction of the engagement hook 71. The width b2 of the lower end edge of the engagement hole 72 is the same as or slightly larger than the width a1 of the base end portion of the engagement hook 71, and a size difference between the both (b2−a1) is set to be smaller than size $\alpha$ shown in FIG. 10B. The size $\alpha$ is a difference between a diameter d of a bolt insertion hole 74 formed below the engagement hole 72 and a diameter c of the female screw hole 73 (screw diameter of a bolt 75).

The beam member 28 is temporarily fastened to the support pillar 27 by engaging the engagement hook 71 with the engagement hole 72, and fixed by screwing the bolt 75 inserted into the bolt insertion hole 74 into the female screw hole 73. More specifically, by inserting the engagement hook 71 into the engagement hole 72 and moving the engagement hook downward, the base end portion of the engagement hook 71 is engaged with a lower edge of the engagement hole 72. At this time, positions of the female screw hole 73 and the bolt insertion hole 74 are matched with each other. Thus, the bolt 75 is inserted into the bolt insertion hole 74 and the bolt 75 is screwed into the female screw hole 73.

As described above, the width a1 of the base end portion of the engagement hook 71 is the same as the width b2 of the lower end edge of the engagement hole 72 or slightly smaller than the width b2. Thus, an almost no gap is generated between the both when the base end portion of the engagement hook 71 is engaged with a lower edge portion of the engagement hole 72. Therefore, variation of a coupling position between the support pillar 27 and the beam member 28 can be reduced. The size difference between the width a1 of the base end portion of the engagement hook 71 and the width b2 of the lower end edge of the engagement hole 72 is smaller than the size difference a between the bolt insertion hole 74 and the female screw hole 73. Thus, by engaging the base end portion of the engagement hook 71 with the lower edge portion of the engagement hole 72, the positions of the bolt insertion hole 74 and the female screw hole 73 can be reliably matched with each other, so that a task of inserting the bolt 75 into the bolt insertion hole 74 and screwing the bolt into the female screw hole 73 can be easily performed.

The engagement hole 72 is formed in such a manner that the width b1 of the upper end edge thereof is larger than the width b2 of the lower end edge. Thus, the engagement hook 71 can be readily inserted into the engagement hole 72. Further, in the engagement, hook 71, the width a2 of the front end portion is smaller than the width a1 of the base end portion. From this, the engagement hook 71 can be also easily inserted into the engagement hole 72.

Figure 12:
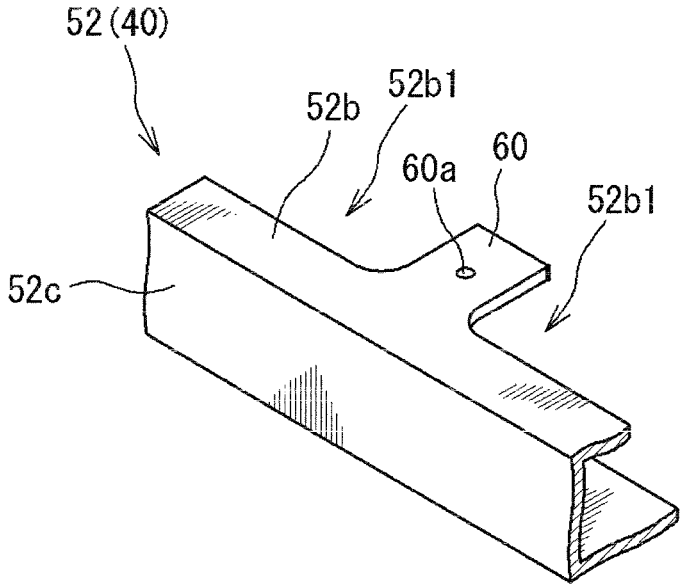
FIG. 12 is a perspective view of a part of a base leg of an outdoor unit according to a second embodiment of the present invention when seen from the obliquely upper side.

FIG. 12 is a perspective view showing a part of a base leg in a second embodiment of the present invention.

A base leg 40 of the present embodiment is different from the above first embodiment in a point, that a support portion 60 provided in a second part 52 is integrated with a standing plate 52*c*. Therefore, a step of manufacturing the support portion (support plate) 60 separately from the base leg 40, and a step of attaching the support portion 60 to the base leg 40 are not required. Thus, manufacturing cost can be reduced.

The present invention is not limited to the above embodiments but can be appropriately changed within the scope of the invention described in the claims.

For example, the base legs 40 are provided on the lower surfaces of the front edge portion and the rear edge portion of the bottom frame 26 in the above embodiments. However, the base legs 40 may be provided on lower surfaces of a right edge portion and a left edge portion of the bottom frame 26, or the base legs 40 may be provided on lower surfaces of the edge portions of all the four sides of the bottom frame 26.

In the base leg 40, the retreat portion 52*b*1 formed in the upper plate 52*b* of the second part 52 is not limited to the mode that the upper plate 52*b* retreats to the outer side in the front and rear direction (horizontal direction) but the retreat portion may be formed for example by a hole or an opening in a shape corresponding to the drainage ports 42 and 44.

The present invention can also be applied to an outdoor unit 2 including an outdoor heat exchanger arranged in a U shape along three side surfaces of the outdoor unit main body 5 or an outdoor heat exchanger arranged in an L shape along two side surfaces of the outdoor unit main body 5.

The present invention is not limited to the upward blow-off type outdoor unit 2 but can also be applied to a sideways blow-off type outdoor unit 2.

The outdoor unit 2 of the above embodiments includes one compressor 11 and one fan 23, and the bottom frame 26 is formed in a substantially regular square shape in a plan view. However, the present invention can also be applied to an outdoor unit 2 including two (or more) compressors 11 and two (or more) fans 23, in which a bottom frame 26 is enlarged in a substantially oblong shape in a plan view. In this case, base legs 40 can be provided in edge portions of long sides and/or short sides of the bottom frame 26.

REFERENCE SIGNS LIST

1: AIR CONDITIONING DEVICE
2: OUTDOOR UNIT
13: OUTDOOR HEAT EXCHANGER
26: BOTTOM FRAME
27: SUPPORT PILLAR
40: BASE LEG
41: MOUNT PORTION
42: DRAINAGE PORT
43: DRAINAGE PASSAGE
44: DRAINAGE PORT
51: FIRST PART
51*a*: LOWER PLATE
51*b*: UPPER PLATE
51*c*: STANDING PLATE
52: SECOND PART
52*a*: LOWER PLATE
52*b*: UPPER PLATE
52*c*: STANDING PLATE
52*b*1: RETREAT PORTION
53: RIB (WATER OUTFLOW PREVENTION STRUCTURE)
60: SUPPORT MEMBER (SUPPORT PORTION)

The invention claimed is:

1. An outdoor unit of an air conditioning device, comprising:
a bottom frame;
a heat exchanger disposed on the bottom frame; and
a base leg provided on a lower surface of the bottom frame below the heat exchanger,
wherein
a drainage port is formed to pass through the bottom frame bellow the heat exchanger,
the base leg is formed to abut with the lower surface of the bottom frame, and to mount on an installment surface,
the base leg further includes
a first part extending in a longitudinal direction of the outdoor unit, and
a second part extending from the first part in the longitudinal direction and immediately adjacent to the first part,
the first part is formed to have a U shape section by a first upper plate abutted with the lower surface of the bottom frame, a first lower plate mounted on and fixed to the installment surface and a first standing plate connecting the first upper plate with the first lower plate, wherein the U shape section of the first part opens outward in a horizontal direction,
the second part is provided at least at a position corresponding to the drainage port with respect to the longitudinal direction and formed to have a U shape section by a second upper plate abutted with the lower surface of the bottom frame, a second lower plate mounted on the installment surface, and a second standing plate connecting the second upper plate with the second lower plate, wherein the U shape section of the second part opens inward in the horizontal direction, the second upper plate avoids a lower region of the drainage port,
the first lower plate and the second lower plate are formed integrally and continuously in the longitudinal direction of the base leg,
the first standing plate rising upwardly from an edge portion inside the lower plate,
the first upper plate extends from an upper end portion of the first standing plate to an outer side in a horizontal direction of the first standing plate,
the second standing plate rising upwardly from an edge portion outside the lower plate,
the second upper plate extends from an upper end portion of the second standing plate to an inner side in a horizontal direction of the second standing plate.

2. The outdoor unit of the air conditioning device according to claim 1, wherein the second upper plate of the second part has a smaller width than the first upper plate of the first part forming a retreat portion at least in the vicinity of the drainage port.

3. The outdoor unit of the air conditioning device according to claim 2, wherein the second part includes:
a support portion protruding horizontally and covering a portion of a void exposed by the retreat portion, and supporting the lower surface of the bottom frame.

4. The outdoor unit of the air conditioning device according to claim 3, wherein the support portion is arranged at a position to avoid the drainage port.

5. The outdoor unit of the air conditioning device according to claim 1, wherein a mount portion for mounting the heat exchanger is formed in the bottom frame while expanding upward, and the drainage port is formed in the mount portion.

6. The outdoor unit of the aft conditioning device according to claim 1, wherein a water outflow prevention structure for preventing an outflow of water from the second lower plate to the first lower plate is provided in a border portion between the first lower plate and the second lower plate or in the second lower plate.

7. The outdoor unit of the air conditioning device according to claim 1, wherein the drainage port passes through the bottom frame in an up and down direction.

8. The outdoor unit of the aft conditioning device according to claim 1, wherein the base leg further includes:

another first part extending in the longitudinal direction of the outdoor unit, wherein the another first part is formed to have a U shape section by an another first upper plate abutted with the lower surface of the bottom frame, an another first lower plate mounted on and fixed to the installment surface and an another first standing plate connecting the another first upper plate with the another first lower plate, wherein the U shape section of the another first part opens outward in a horizontal direction, the lower plate of both the first part and the another first part and the lower plate of the second part are formed integrally and continuously in the longitudinal direction of the base leg such that the the first part and the another first part are arranged on opposite sides of the second part in the longitudinal direction, the another first standing plate rising upwardly from an edge portion inside the another first lower plate, the another first upper plate extends from an upper end portion of the another first standing plate to an outer side in a horizontal direction of the another first standing plate.

* * * * *